United States Patent [19]

Seppänen

[11] Patent Number: 4,778,371

[45] Date of Patent: Oct. 18, 1988

[54] APPARATUS FOR FORMING FROGS IN THE SIDES OF A CONCRETE ELEMENT

[75] Inventor: Aimo Seppänen, Valkeakoski, Finland

[73] Assignee: KT-SUUNNITTELU Oy, Valkeakoski, Finland

[21] Appl. No.: 1,876

[22] Filed: Jan. 9, 1987

[30] Foreign Application Priority Data

Jan. 17, 1986 [FI] Finland ..... 860236

[51] Int. Cl.[4] ..... B28B 11/08; B28B 11/12

[52] U.S. Cl. ..... 425/290; 264/145; 264/154; 425/63; 425/308; 425/385; 425/457

[58] Field of Search ..... 425/62–65, 425/111, 299, 308, 324.1, 325, 385, 431, 446, 456, 457, 290; 264/145, 154, 156

[56] References Cited

U.S. PATENT DOCUMENTS

| | | | |
|---|---|---|---|
| 214,374 | 4/1879 | Dows et al. | 425/300 |
| 850,428 | 4/1907 | Grant | 425/385 |
| 1,160,307 | 11/1915 | Mattes | 425/308 |
| 1,559,682 | 11/1925 | Doughty | 425/385 |
| 1,787,219 | 12/1930 | Trotter et al. | 425/385 |
| 2,031,899 | 2/1936 | Mattes | 425/385 |
| 2,582,645 | 1/1952 | Milliken et al. | 425/308 |
| 2,583,600 | 1/1952 | Schreiber | 425/208 |
| 3,044,391 | 7/1962 | Pellett | 425/62 |
| 3,781,154 | 12/1973 | Herbert et al. | 425/64 |
| 3,904,341 | 9/1975 | Putti | 425/64 |
| 3,972,666 | 8/1976 | Pandur | 425/208 |
| 4,125,348 | 11/1978 | Martens | 425/385 |
| 4,133,619 | 1/1979 | Wise | 425/64 |
| 4,568,503 | 2/1986 | Laine et al. | 425/426 |
| 4,608,216 | 8/1986 | Barsk | 425/427 |
| 4,668,447 | 5/1987 | Paakkinen | 425/426 |
| 4,674,970 | 6/1987 | Kankkunen | 425/456 |
| 4,674,971 | 6/1987 | Kankkunen | 425/456 |

FOREIGN PATENT DOCUMENTS 175930 4/1986 European Pat. Off. .

*Primary Examiner*—Jay H. Woo
*Assistant Examiner*—James C. Housel
*Attorney, Agent, or Firm*—Birch, Stewart, Kolasch, & Birch

[57] ABSTRACT

An apparatus for forming frogs in the sides of a slip-formed concrete element, especially a hollow-core slab is disclosed. In accordance with the invention, the frogs are formed in the sides of the element by removing cast material from the sides by a reciprocative scraping action. The reciprocative movement parallel to the side of the element is effected with a drive motor and a lever assembly. By the method, it is possible to obtain a desired frog shape and depth without damaging the side surfaces.

14 Claims, 4 Drawing Sheets

APPARATUS FOR FORMING FROGS IN THE SIDES OF A CONCRETE ELEMENT

FIELD OF THE INVENTION

The present invention relates to a method for forming frogs in the sides of a concrete element.

The invention also provides an apparatus for the implementation of the method.

To reinforce the joints of hollow-core concrete elements in the horizontal direction, the sides of the slabs are provided with a sufficient number of frogs, suitably deep, which are filled with concrete during the construction for connecting adjacent slabs to each other. In practice, the requirement for frogs varies greatly with the magnitudes of horizontal forces imposed on the joints between the slabs.

DESCRIPTION OF THE BACKGROUND ART

In prior art methods the frogs are formed during the slipforming process by pressing indentations with a tooth wheel or a tooth belt mat into the sides of the formed element.

A disadvantage of the prior art technique is that difficulty is often encountered when the desired frog shape is formed by pressing because the additional compression of the concrete is counteracted by the binding forces of the compacted and sheared concrete, which tend to retain the original form of the element, consequently inhibiting the forming of frogs with a desired depth of indentations. Also, the area surrounding the frog indentations tends to raise from the imposed pressure, leading to a deformed shape in the sides of the element. Additionally, the prior art technique makes it difficult to change the depth or mutual distance of frogs as changing of the pressing roller or belt mat is required. Achieving a desired frog depth may be impossible with the conventional technique because a deeper frog depth requires a high compressing force, and excessive compression will break the hollow-core construction.

SUMMARY OF THE INVENTION

The present invention aims to overcome the disadvantages of the aforementioned technique, and to achieve a completely novel method for the fabrication of frogs in hollow-core elements.

The invention is based on forming the frogs in the element by removing cast concrete from the elements by a reciprocative scraping action.

More specifically, the method in accordance with the invention is characterized by forming frogs in the sides of a slipformed concrete element, especially a hollow-core slab, in which the frogs are formed by removing cast concrete from the sides of the element by a reciprocation action.

Furthermore, the present invention provides for an apparatus in which frogs are formed in the sides of a slipformed concrete element, especially a hollow-core slab. This apparatus comprises support members which may be reciprocated parallel to the side of the element, a scraper and a transfer means.

The invention provides appreciable benefits.

The frog-forming apparatus in accordance with the present invention can be mounted to allow the continuous visual monitoring of its operation. The shape, depth, and mutual distance of the frogs is freely adjustable, in addition to the possibility of discontinuing the frog-forming process when required.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
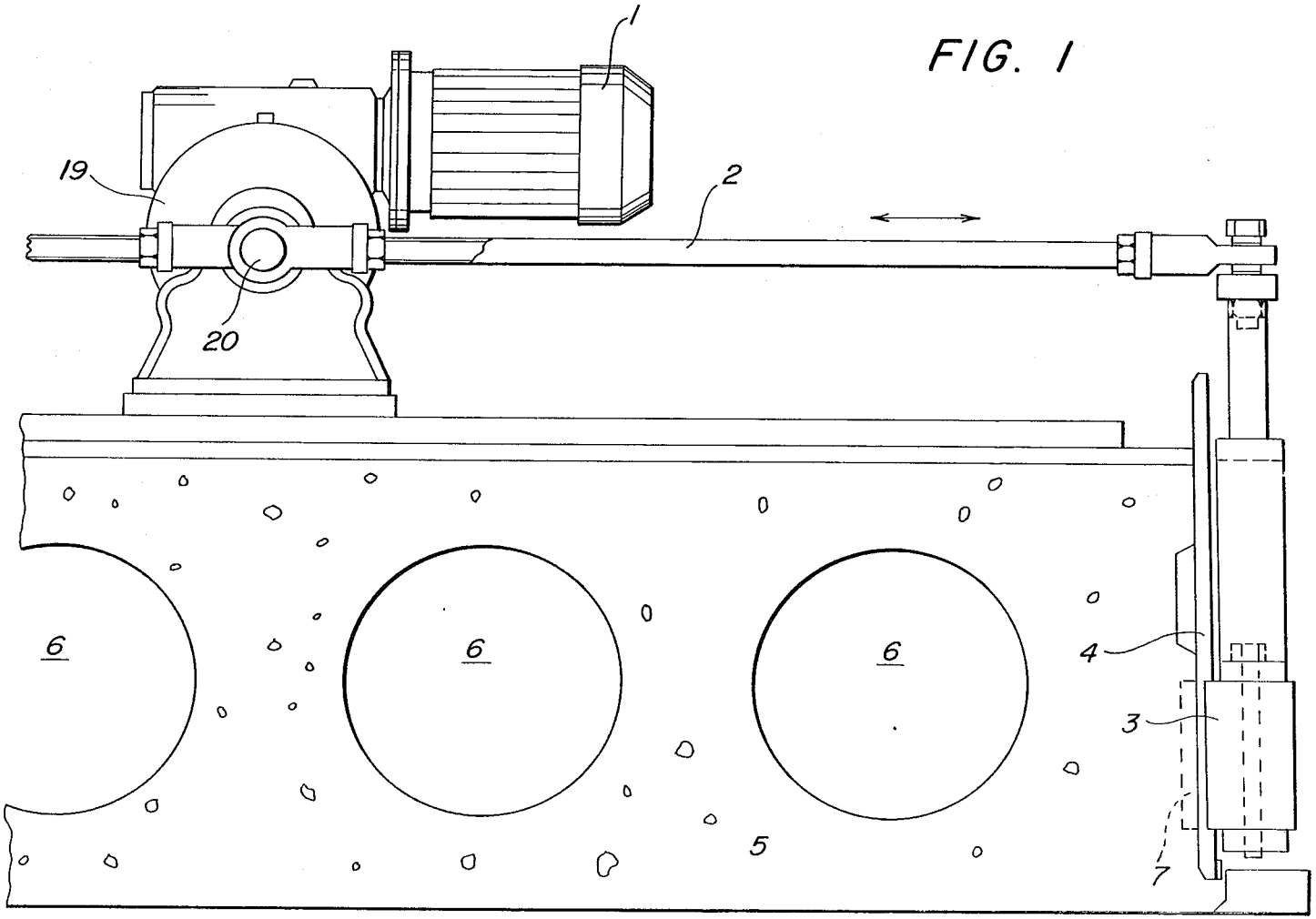
FIG. 1 shows a side view, parallel to the cores, of an embodiment of the frog-forming apparatus of the present invention in which the scraping is performed in the direction of the hollow cores.
Figure 2:
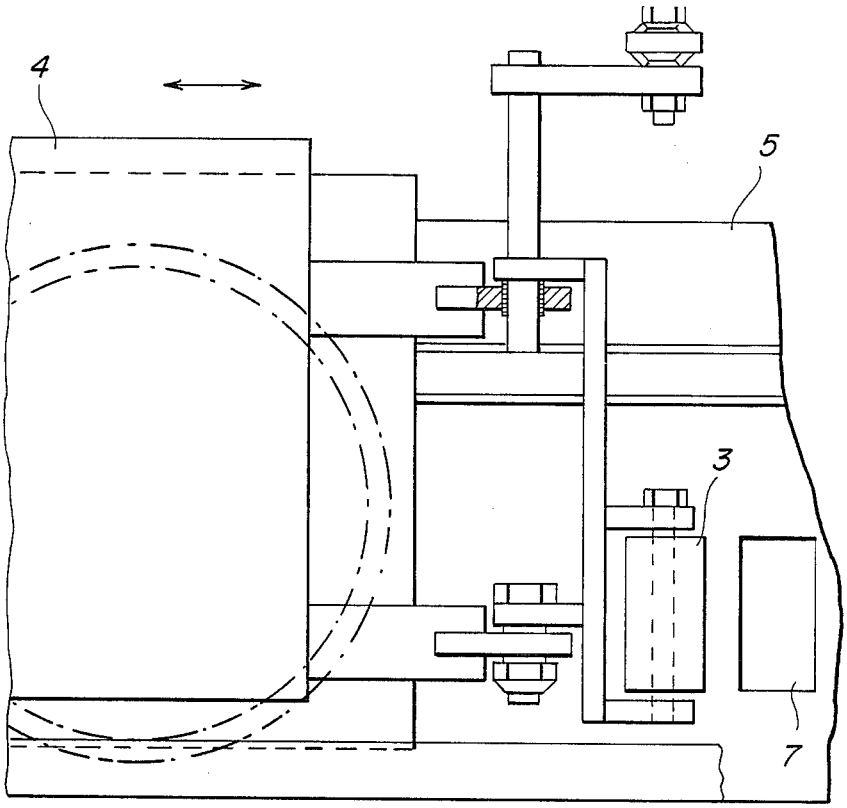
FIG. 2 shows a side view perpendicular to the side view of FIG. 1 of the frog-forming apparatus of the present invention.

FIG. 1 shows an embodiment of the present invention for the implementation of the frog-forming apparatus. The integrated equipment is attached to a slipforming machine. A shaft 20 of a gear box 19 of a motor 1 is attached eccentrically to a crankshaft 2. This shaft 2 is reciprocatingly movable for generating movement of a scraper 3 in a perpendicular direction in relation to the side of a hollow-core element 5, with which movement the scraper 3 can be connected or disconnected. The actual scraping action parallel to hollow cores 6 of the element is achieved with a moving side mold 4, driven by, for instance, an electric motor (not shown). A frog 7 is formed when the crankshaft 2, driven by the motor 1, draws the scraper 3 against the side of the element 5 so that the scraper 3 removes cast concrete from the element 5 when moving in a reciprocative manner parallel to the hollow cores 6. The desired frog depth is adjusted by the stroke length of the crankshaft 2, determined by the eccentricity of the attachment of the crankshaft 2 to the motor. The length and mutual distance of the frogs 7 is determined by both the rotation speed of the motor 1 and the operating speed of the slipforming machine.

Figure 3:
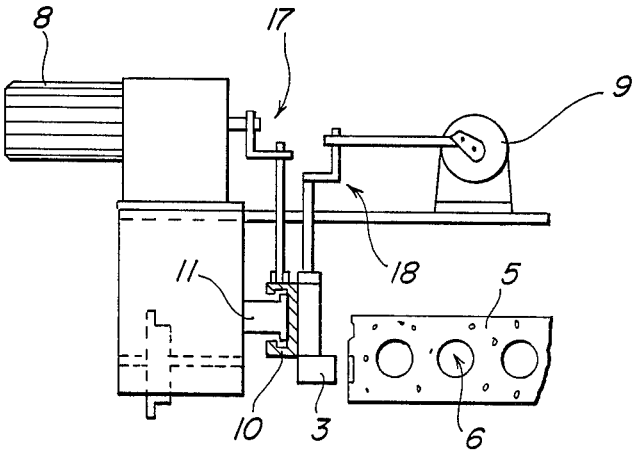
FIG. 3 shows in side view another embodiment of the frog-froming apparatus of the present invention in which th reciprocative scraping movement is parallel to the hollow cores of the hollow-core element.
Figure 4:
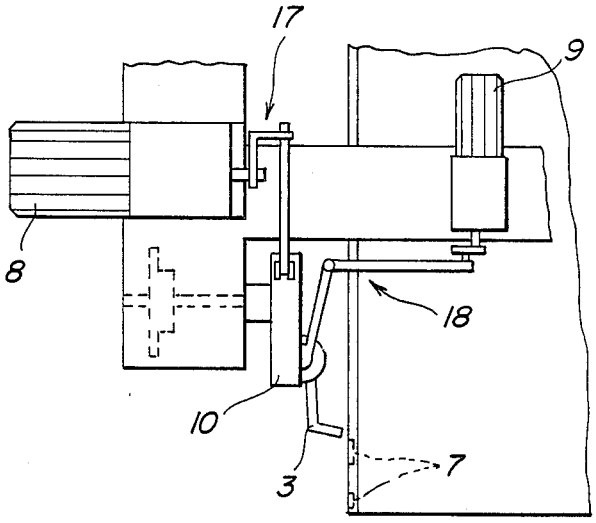
FIG. 4 shows in top view a frog-forming apparatus in accordance with FIG. 3.

FIG. 3 illustrates a mechanism for the implementation of the reciprocative movement. The shaft of a motor 8 is attached to a lever assembly 17, which converts the rotation movement into a reciprocative movement parallel to the hollow-cores 6 of the element. The lever assembly is connected to a case 10, which reciprocates along a rail 11, connected to the slipforming machine. A second motor 9 operates as a drive for a lever assembly 18, which reciprocates the scraper 3 which is connected with joints to the case 10. The scraper 3 reciprocates toward and away from the side of the element.

Figure 5:
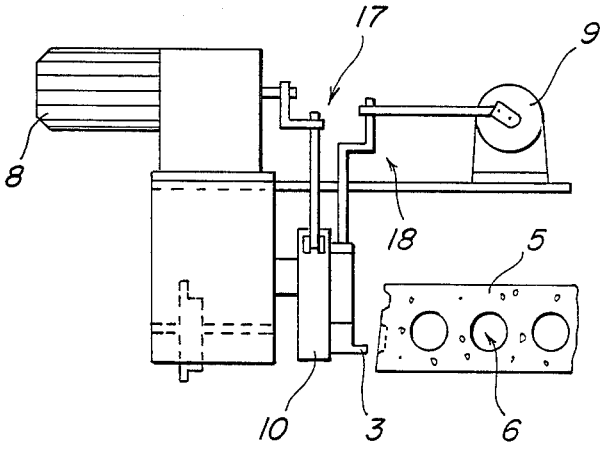
FIG. 5 shows in side view a frog-forming apparatus, in which the reciprocative scraping movement is perpendicular in respect to the hollow cores of the hollow-core element.
Figure 6:
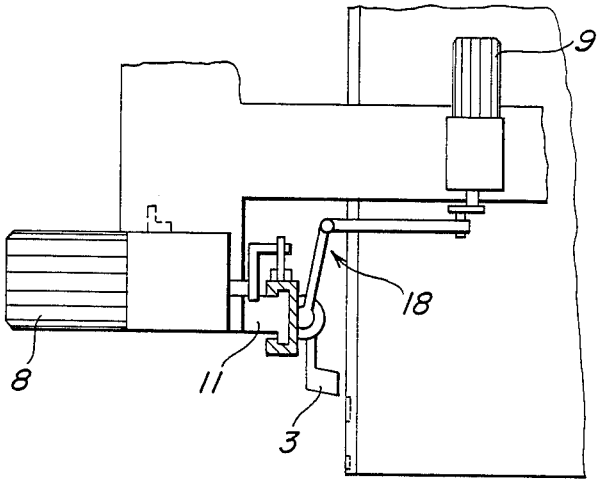
FIG. 6 shows in top view a frog-forming apparatus in accordance with FIG. 5.

FIG. 5 illustrates a mechanism, with which the reciprocative scraping movement is adapted to be perpendicular to the longitudinal axis of the hollow cores 6. In this case, the rail 11 is mounted in a vertical position to achieve the desired direction of movement.

Principally, the direction of the scraping movement is not limited to those directions mentioned in the foregoing but all directions essentially parallel to the plane of the element side are technically feasible and possible to implement.

The rate of the scraping movement can be 1 . . . 100 Hz.

Figure 7:
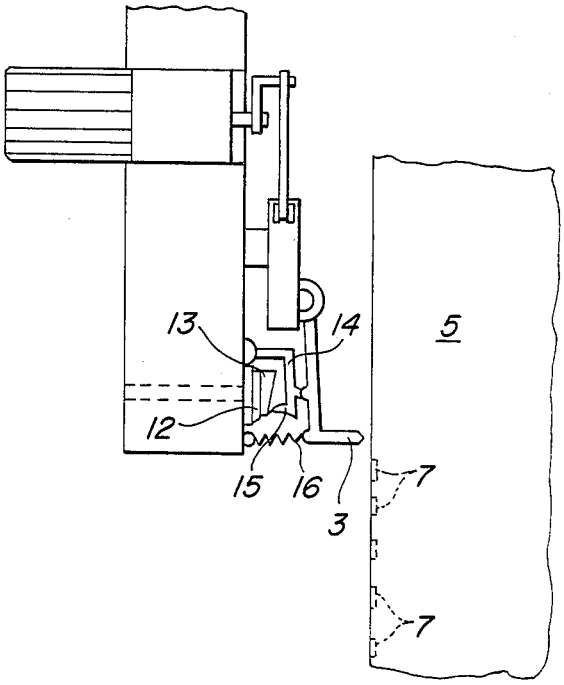
FIG. 7 shows in top view an adaptation for transferring the scraper to and away from the element.

FIG. 7 shows an embodiment in which a wedge-shaped member 13 is attached to a wheel 12 of the slipforming machine and which implements the reciprocative movement of the scraper approximately perpendicular to the side of the element 5. An auxiliary lever 14 is connected to the shaft of the scraper 3. A peg 15 of the auxiliary lever remains in contact with the wedge member 13 during the rotation of the slipforming machine wheel 12, and when the peg 15 is at the thickest part of the wedge 13, the scraper 3 is deepest in the element 5. The return movement of the scraper 3 is effected with a spring 16, connected to the scraper shaft and with its other end connected to the chassis of the slipforming machine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for forming frogs in at least one side of a slip-formed concrete element, said element having longitudinally extending sides, said apparatus comprising:

scraper means for making frogs in at least one of said longitudinal sides of the element by removing concrete material from said at least one side, said scraper means being reciprocated in first and second substantially orthogonal directions, said first direction being generally perpendicular to said longitudinal sides of said element in order to make said frogs;

transfer means for reciprocating said scraper means in said first direction; and support means for moving said scraper means in said second direction, said support means comprising a lever assembly, means for driving said lever assembly, a case connected to said lever assembly and being movable in said second direction, and a rail means for guiding said case in said second direction.

2. The apparatus for forming frogs as recited in claim 1, wherein said rail means guides said case in a direction generally parallel to said longitudinal sides of said element.

3. The apparatus for forming frogs as recited in claim 1, wherein portions of said transfer means and said scraper means are affixed to said case, said portion of said transfer means including a lever arm which is pivotably mounted on said case and is attached to said portion of said scraper means for moving said scraper means in said first direction when said lever arm is pivoted.

4. The apparatus for forming frogs as recited in claim 1, wherein said case has a front side to which a lever portion of said transfer means is pivotably attached, said lever portion being connected to said scraper means in order to permit movement of said scraper means in said first direction, said means for driving, said lever assembly and said rail means being positioned behind said front side while said element is positioned in front of said front side.

5. The apparatus for forming frogs as recited in claim 1, wherein said transfer means comprises;

a motor; and a lever assembly extending between said motor and said scraper means for permitting said scraper means to move in said first direction.

6. The apparatus for forming frogs as recited in claim 2, wherein said transfer means comprises;

a motor; and a lever assembly extending between said motor and said scraper means for permitting said scraper means to reciprocate in said first direction.

7. The apparatus for forming frogs as recited in claim 1, wherein said transfer means comprises;

a rotatable wedge-shaped member having a front surface acting as a cam when said wedge-shaped member is rotated; and an auxiliary lever being in contact with said front surface and being movable toward and away from said element in response to rotation of said wedge-shaped member, said scraper means being in contact with said auxiliary lever whereby said scraper means is reciprocated in said first direction in response to movement of said auxiliary lever.

8. The apparatus for forming frogs as recited in claim 7, wherein said wedge-shaped member, said auxiliary lever and said scraper means are in nonaffixed contact and wherein said scraper means has a spring attached thereto for causing said scraper means to move away from said element in said first direction when said auxiliary lever moves away from said element.

9. The apparatus for forming frogs as recited in claim 7, wherein said rotatable wedge-shaped member has a rotatable wheel attached thereto, said wheel causing said wedge-shaped member to rotate when said wheel is rotated.

10. The apparatus for forming frogs as recited in claim 7, wherein said rotatable wedge-shaped member is mounted on a frame and said auxiliary lever is pivotably mounted on said frame, said auxiliary lever extending in a U-shape from a first end affixed to said frame to a second end in contact with said wedge-shaped member, said second end being nonaffixed to said wedge-shaped member and said scraper means contacting said auxiliary lever at a position between said first and second ends.

11. The apparatus for forming frogs as recited in claim 7, wherein said front surface of said wedge-shaped member is in a plane which is nonparallel with an edge of said element.

12. The apparatus for forming frogs as recited in claim 1, wherein said transfer means comprises;

a rotatable wedge-shaped member having a front surface acting as a cam when said wedge-shaped member is rotated; and an auxiliary lever being in contact with said front surface and being movable toward and away from said element in response to rotation of said wedge-shaped member, said scraper means being in contact with said auxiliary lever whereby said scraper means is reciprocated in said first direction in response to movement of said auxiliary lever.

13. The apparatus for forming frogs as recited in claim 1, wherein said scraper means is reciprocated at a rate in the rang of 1 to 100 Hz by said transfer means.

14. The apparatus for forming frogs as recited in claim 13, wherein said rate is generally 50 Hz.

* * * * *